United States Patent [19]

Artzt et al.

[11] Patent Number: 5,007,136

[45] Date of Patent: Apr. 16, 1991

[54] PROCESS FOR THE PRODUCTION OF A YARN FROM FIBER MATERIAL

[75] Inventors: Peter Artzt, Reutlingen; Heinz Mueller, Metzingen-Neuhausen, both of Fed. Rep. of Germany

[73] Assignee: Schubert & Salzer Maschinenfabrik Aktiengesellschaft, Ingolstadt, Fed. Rep. of Germany

[21] Appl. No.: 559,388

[22] Filed: Jul. 24, 1990

Related U.S. Application Data

[63] Continuation of Ser. No. 383,854, Jul. 21, 1989, abandoned.

[51] Int. Cl.[5] ..... D01B 9/00; D01G 12/00

[52] U.S. Cl. ..... 19/65 A; 19/98; 19/115 R; 19/228

[58] Field of Search ..... 19/65 A, 65 R, 115 R, 19/228, 106 R, 98, 297, 300

[56] References Cited

U.S. PATENT DOCUMENTS

| | | | |
|---|---|---|---|
| 2,795,012 | 6/1957 | Gibson et al. | 19/98 |
| 3,577,598 | 5/1971 | Schwarz | 19/65 |
| 3,987,615 | 10/1976 | Hill, Jr. | 57/156 |
| 4,088,016 | 5/1978 | Watson et al. | 73/160 |
| 4,137,487 | 1/1979 | Niestroj et al. | 318/39 |
| 4,225,244 | 9/1980 | Schwarz | 356/434 |
| 4,253,215 | 3/1981 | Mangialardi, Jr. | 19/66 CC |
| 4,281,438 | 8/1981 | Welker et al. . | |
| 4,434,531 | 3/1984 | Mondini | 19/99 |
| 4,700,431 | 10/1987 | Artzt et al. . | |
| 4,703,431 | 10/1987 | Sako et al. | 364/470 |
| 4,704,031 | 11/1987 | Ulrich et al. | 356/350 |
| 4,812,993 | 3/1989 | Konig et al. | 364/470 |

FOREIGN PATENT DOCUMENTS

| | | |
|---|---|---|
| 247420 | 12/1987 | European Pat. Off. . |
| 1510304 | 7/1969 | Fed. Rep. of Germany . |
| 232766 | 2/1986 | Fed. Rep. of Germany . |
| 2534600 | 10/1983 | France . |
| 246823 | 12/1985 | Japan . |
| 886396 | 1/1962 | United Kingdom . |

OTHER PUBLICATIONS

Morton and Hearle, *Physical Properties of Textile Fibers*, 1975, pp. 111–114.

*Primary Examiner*—Werner H. Schroeder
*Assistant Examiner*—Michael A. Neas
*Attorney, Agent, or Firm*—Dority & Manning

[57] ABSTRACT

The fiber material (of which a yarn is to be spun) is drawn and combed after carding. In order to determine the combing intensity, a sample is taken from the fiber material after carding and is subjected to an analysis for fiber length and/or impurities. Certain limits are set for fiber length and/or impurities and the combing intensity is adjusted according to the results of the analysis. The fiber material treated with this combing intensity is again drawn and is then opened into individual fibers which are incorporated into a continuously spun and drawn-off yarn.

15 Claims, 4 Drawing Sheets

PROCESS FOR THE PRODUCTION OF A YARN FROM FIBER MATERIAL

This is a continuation of application Ser. No. 07/383,854, filed July 21, 1989, which was abandoned upon the filling hereof.

BACKGROUND OF THE INVENTION

The instant invention relates to a process for the production of a yarn from fiber material which is drawn after carding, then combed, drawn again, and then spun.

Such a process is usual for the production of high-quality ring-spun yarns (U.S. Pat. No. 2,809,401). The combing action increases the average length of the fibers in the yarn since most of the short fibers are combed out. Furthermore, impurities, short fibers, dust and fiber tufts which could not be removed in the preceding preparation steps are combed out. In addition, the parallel orientation of the fibers in the yarn is improved. However, this process for the production of a yarn is very expensive.

SUMMARY OF THE INVENTION

It is, therefore, the object of the instant invention to provide a process of this type in which the expense of producing high-quality yarn can be reduced.

This object is attained through the instant invention by removing a sample quantity from the fiber material after carding. This ample is subjected to an analysis to determine the fiber length and/or impurities in the sample. Certain limits are then set for the fiber length and/or impurities and the intensity of combing is predetermined in function thereof. The fiber material is combed with this combing intensity and it is opened into individual fibers after it has been drawn. The individual fibers are incorporated into the continuously drawn-off yarn.

By contrast with the ring spinning process (in which the fiber material to be spun goes through several steps in which the parallel orientation of the fibers is improved up to and even during the spinning process itself) in the open-end spinning process the fiber material loses its parallel orientation since the fiber material is opened down to single fibers.

These single fibers must be reoriented while being conveyed to an open-end spinning element, while the costly ring spinning process uses combing to improve the parallel orientation of the fibers within the fiber sliver. In ring-spun yarns, the fiber sliver from which short fibers, husks, dust and fiber tufts are eliminated is always maintained intact. By contrast thereto, in the process of the invention, such impurities as well as short fibers are separated from the fibers to be spun in the phase during which the fiber material is in its opened state. Thus, a combing process (which is an additional operation) cannot lead to yarn improvements in open-end spinning such as that obtained with ring-spun yarn. Surprisingly, however, it has been found that, in spite of the fact that the parallel position of the fibers after separation of the fibers into individual fibers must be imparted again (according to the instant invention) during the conveying of the fibers from an opening device to an open-end spinning device and during the depositing of the fibers on a fiber collecting surface, it is advantageous to subject the fiber material to a combing process. The fiber material to be spun into an open-end spun yarn should, however, not be combed out indiscriminately but only with a predetermined intensity which depends on the nature of the fiber material. In order to be able to determine this intensity the fiber material to be spun is subjected, after carding, to an analysis with respect to fiber length and/or impurities whereby limits for minimum fiber lengths and/or maximum impurities are set. Depending on the analysis results obtained, the combing intensity is then predetermined and the material is combed with that combing intensity. It has been found that the improvements which can be obtained in the yarn are insufficient when the combing intensity is too low, i.e., that too many short fibers or impurities are still contained in the fiber material. If the combing intensity is too great, on the other hand, the possible improvements are diminished. This leaves, therefore, an optimal range with respect to expense as well as to improvement of yarn characteristics such as strength, work capacity and resistance to tearing.

It has been proven advantageous to determine the total frequency of the fiber lengths below a certain limit in percentage after carding the fiber material and before it has been subjected to the combing process and to predetermine the combing intensity as a function of the percentage thus obtained. In this way, the short fibers which cannot contribute to the strength of the yarn are removed by the combing process.

It has been found to be useful in this case to choose 5 to 6.5 mm as the lower limit for fiber length.

As an alternative, or possibly in addition to the above-described process for the determination of combing intensity, the residual impurities can be measured in the fiber material after it has been subjected to the combing process, and the combing intensity is then determined in such manner that these residues lie between 0.04 and 0.02 percent.

It has also been found that the yarn results can be influenced by the state of the fiber material during the combing process. The more uniform the fiber material to be combed is, the fewer will be the deviations in yarn uniformity. It is thus found according to a further essential characteristic of the invention that the fiber material should be rendered uniform before the combing process. In principle, this regulating process can be carried out at any time before the combing process. However, it has been found to be advantageous for this regulation to be carried out during the carding and/or drawing.

In order to produce high-quality yarns according to the instant invention, it is not necessary to install special devices or machines, but it suffices to use machines and devices which exist in almost any spinning plant. It is merely necessary to introduce the combing and drawing steps into the normal sequence of preparation for the open-end spinning, and this does not present any problem in conventional spinning plants. The instruments needed to carry out an analysis are, as a rule, present in a spinning plant, so that the performance of such analyses also does not present any problem.

BRIEF DESCRIPTION OF THE DRAWINGS

Several examples of the process according to the invention are described through the drawings in which.

DETAILED DESCRIPTION OF THE INVENTION

Figure 5:
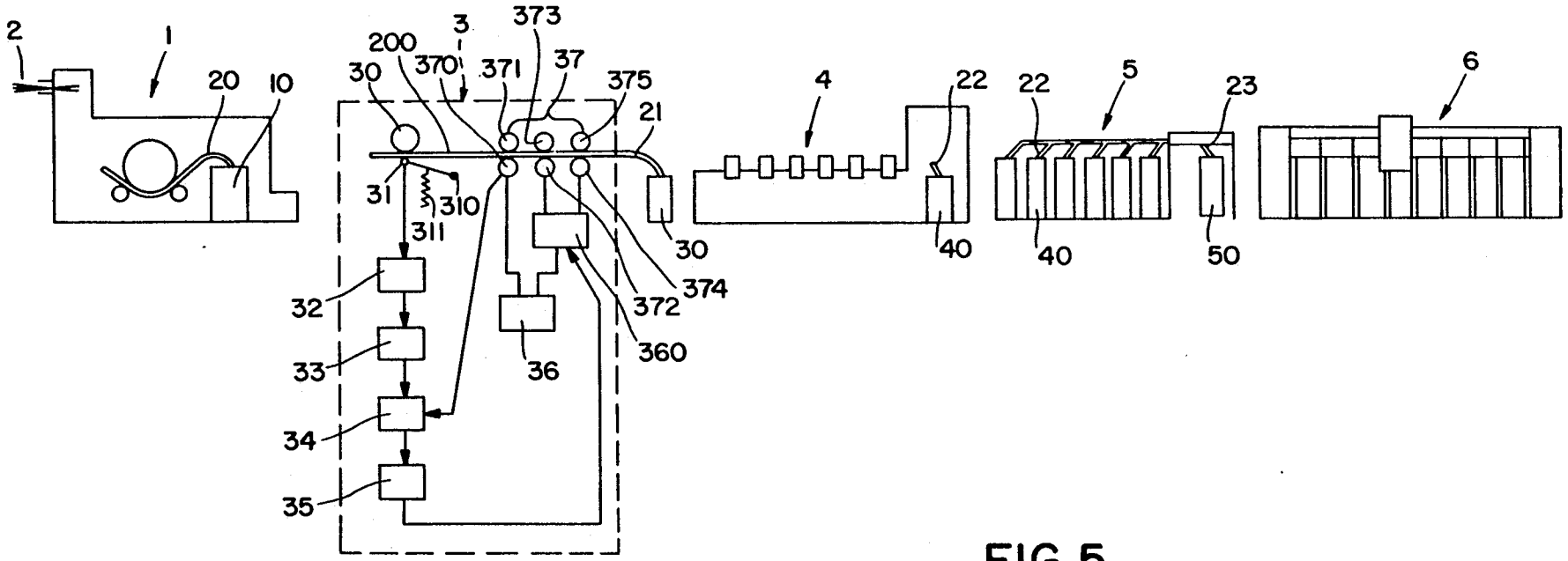
FIG. 5 shows a schematic view of the machines which are required for the preparation of yarn to be spun in accordance with the instant invention.

The invention is first described through FIG. 5.

The fiber material 2 is prepared in the known manner and is presented to a card 1 of conventional construction in form of flocks or fleece or lap. The fiber material leaves the card 1 in form of a fiber sliver 20 which is deposited in a can 10.

A sample is taken from sliver 20 in order to conduct an analysis 7 (see FIG. 1) which will be used to adjust a combing machine 4. This analysis is conducted by means of a vibrograph, for example, reproducing the distribution of lengths in the fibers in form of a vibrogram.

Figure 3:
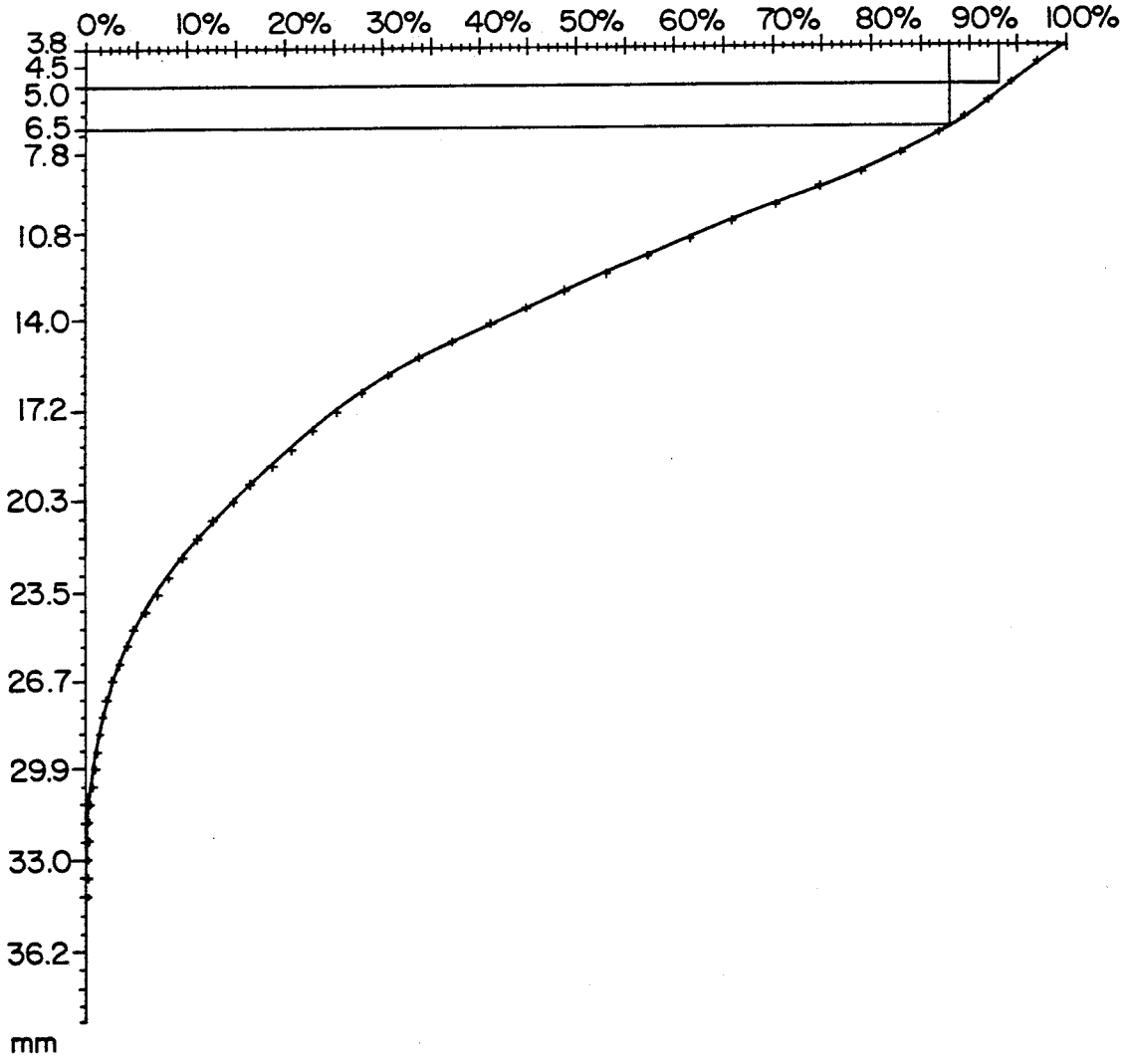
FIG. 3 shows a total frequency graph to predetermine the combing intensity.

Such a diagram is shown in FIG. 3. The fiber frequency, in percentage, is shown on the horizontal axis and the fiber length, in millimeters, is shown on the vertical axis.

The vibrogram given as an example in FIG. 3 shows that 100 percent of all fibers have a length of at least 3.8 mm. Approximately 93 percent of all fibers have a length of 5 mm or over and approximately 88 percent of all fibers have a length of 6.5 mm or over. As the diagram shows, the portion of fibers out of the overall fiber quantity decreases as the fiber length increases, until finally no more fibers are found with a fiber length of over approximately 34 mm.

It has also been found that fibers with a length below 5 to 6.5 mm cannot contribute to the strength of the spun yarn. For this reason, the percentage of all fibers with a length that is shorter than the minimum length of 5 to 6.5 mm is determined through the curve shown in FIG. 3. The vibrogram shows for 5 mm, for example, that 7 percent of all the fibers are shorter than 5 mm. The same curve shows that 12 percent of all the fibers are shorter than 6.5 mm. The 7 to 12 percent thus found serve to adjust the combing intensity of the combing machine 4, as indicated earlier (see, for example, in German Patent No. DE 29 40 366 A1 or its U.S. Pat. No. 4,281,438).

When the combing machine 4 has been adjusted accordingly, the fiber sliver 20 (from which the sample was analyzed) is conveyed to a drawing frame 3 on which said fiber sliver 20 is drawn and doubled with five or more other fiber slivers 20 to constitute a new fiber sliver 21 of the same thickness but with greater uniformity than the presented fiber slivers 20. This fiber sliver 21 is deposited in a can 30.

The cans 30 containing fiber slivers 21 are now presented in this form, or after having been brought together with other fiber slivers 21 to constitute a lap or fleece, in form of fleeces to the combing machine 4 where this fiber material is subjected to a combing process.

As indicated earlier, the combing machine 4 is adjustable to different combing intensities depending upon the results of the analysis. The combing intensity is determined by combing depth, so that different quantities of fibers can be combed out in form of waste from the fiber material presented, in function of the setting. Thus, short fibers, husks, dust and fiber tufts are eliminated from the fiber material during the combing.

Cans 40 containing fiber slivers 22 are now presented to a further drawing frame 5 for the drawing and doubling of fiber slivers 22 and to constitute a new fiber sliver 23 of even greater uniformity. This fiber sliver 23 is deposited in a can 50.

The fiber slivers 23 deposited in cans 50 are now presented to an open-end spinning machine 6 of conventional design. The open-end spinning machine 6 may be a rotor spinning machine, for example, or a friction spinning machine. The fiber slivers 23 are separated in the usual manner into fibers in the open-end spinning machine 6. These separated fibers are subjected to a cleaning process during which impurities such as husks, etc. which remain are removed from the fiber stream while it is conveyed pneumatically to a fiber collecting surface. The fibers thus cleaned are then deposited on the fiber collecting surface where they are incorporated by spinning into the end of a yarn. The yarn thus spun is drawn off in the usual manner and is wound on a bobbin.

Figure 1:
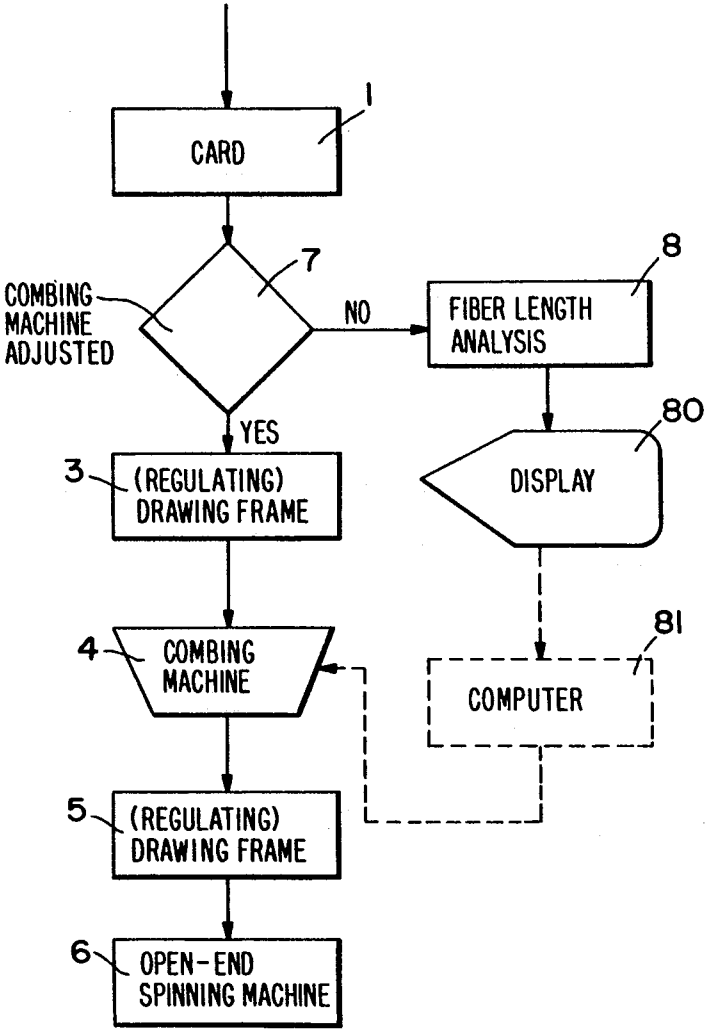
FIG. 1 shows a flowchart of the process according to the invention.

The process described above through FIGS. 3 and 5 shall now be explained again in its entirety through the flowchart shown in FIG. 1.

When the fiber material, in form of a fiber sliver 20 has left the card 1, a verification is made (see field 7 of the flowchart) to see whether an analysis has already been conducted and whether the combing machine 4 has already been adjusted accordingly. This will not be the case at the start of processing a given fiber material. As the flowchart shows, a fiber-length analysis 8 is carried out in this case. The results are displayed on a display device 80 (screen, printer). The displayed data are now used for the adjustment of the combing machine 4. It is also possible to control the combing machine 4 directly by means of a computer 81 in response to this data.

Following the analysis 8 of fiber lengths and the adjustment of the combing machine 4, the fiber sliver produced by the card 1 is conveyed to the drawing frame 3. This material is drawn in the manner described and is then presented to the combing machine 4. In accordance with the previously made adjustment, a certain amount of the fiber material is combed out in the form of waste on the combing machine 4. This combed-out material consists, in particular, of undesirable short fibers as well as equally undesirable impurities.

Upon leaving the combing machine 4, the fiber material reaches the drawing frame in form of fiber slivers 22 and goes from there to the open-end spinning machine 6 to be spun into yarn.

Figure 2:
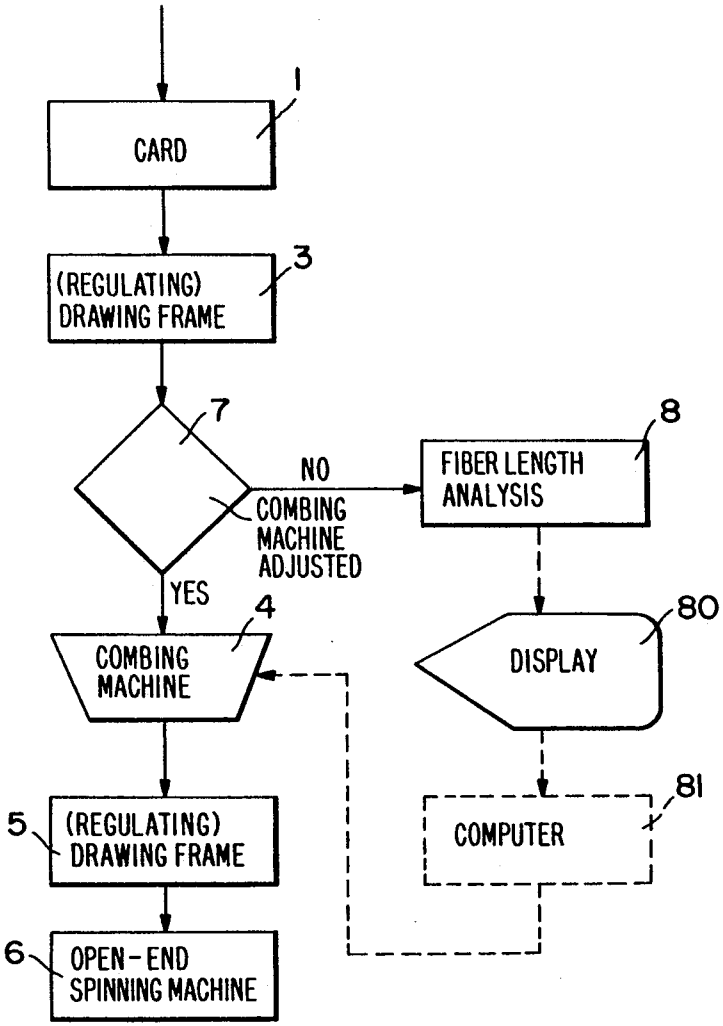
FIG. 2 shows a flowchart of a variation of the process according to the invention.

FIG. 2 shows that it is not necessary for the fiber sliver 20 leaving the card 1 to be subjected to the fiber-length analysis 8, but that it is also possible to carry out this fiber-length analysis on the fiber sliver 21 leaving the drawing frame 3.

When the analysis has been completed, the fiber material can be treated continuously from the card to the open-end spinning machine, but it is also possible to take material samples at any time for the current transformation process in order to carry out additional fiber-length analyses 8 and thereby to control the adjustment of the combing machine 4.

Test results have shown that in order to obtain optimal yarn results, a combing intensity between 10 and 18 percent yields the best results, as a rule. If less than 10 percent of the fiber material presented to the combing machine 4 is combed out, the improvement in the yarn obtained is negligibly low, since too many short fibers and impurities remain in the fiber material. In that case, the high costs and the time expenditures for the production of the yarn are not justified. If more than 18 percent are combed out, the possible improvement again decreases while the costs increase because a great percentage of good fibers is being combed out. It has been shown that, as a rule, combing out from 10 to 18 percent of the fiber material presented to the combing machine 4 increases the qualities of the yarn obtained on the open-end spinning machine 6 to a high degree. At the same time, the improvement which can be obtained in the open-end spun yarn depend on the fiber material to be spun, i.e., on the fiber characteristics such as fiber length, fiber fineness, fiber thickness as well as fiber mixture, fiber quality, drawing, etc. A fiber-length analysis 8 must, therefore, be carried out for each new batch of fibers to be spun, in order to determine the optimal setting of the combing machine 4.

The process described not only makes it possible to achieve better results with respect to yarn quality, but also with respect to its characteristics during further processing, i.e., during knitting or weaving. This applies in particular to breaking strength and to resistance to tearing.

It is also possible to determine the setting of the combing machine 4 in a manner other than that shown above through FIGS. 1 and 2. Such a variation of the process shall now be described with reference to FIG. 4.

Figure 4:
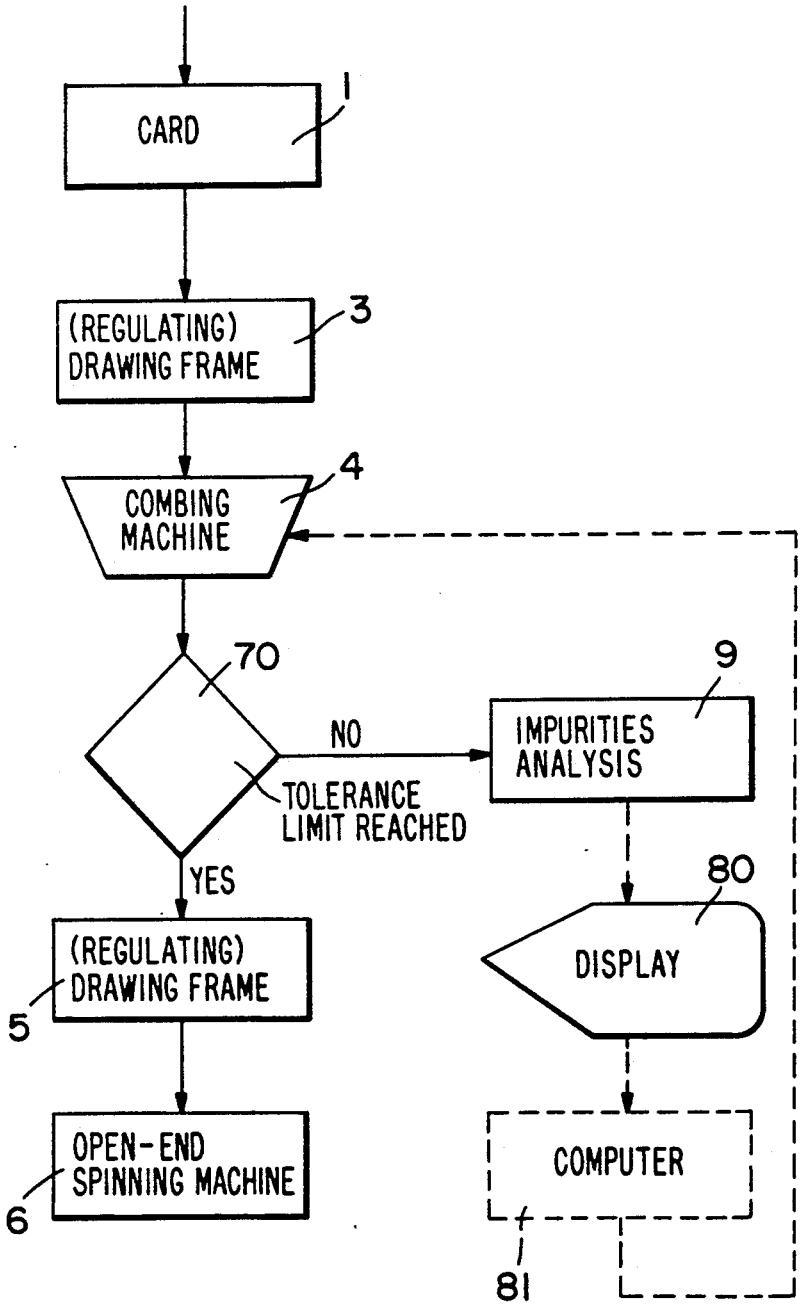
FIG. 4 shows a flowchart of another variation of the process according to the invention.

As the flowchart of FIG. 4 shows, the fiber material is analyzed only after having gone through the combing process. A determination is made as to whether a preset impurities limit in the processed material is being exceeded or not (in field 70). This analysis 9 for impurities can, for example, be carried out by spinning a certain amount of fiber material into a yarn and by weighing this yarn. During the spinning process, impurities are eliminated in a known manner through a dirt collection opening in a known fiber sliver opening device. These impurities are also measured, and their ratio to the spun material is determined. It has been shown that the best results are obtained if the combing machine 4 is set so that the residue of impurities falls between 0.02 and 0.04 percent.

The analysis 9 for impurities can, however, also be carried out by means of a special device such as is shown in U.S. Pat. No. 4,700,431. In determining the residue of impurities, the dust particles which were eliminated by means of a dust collecting device are not taken into account.

Here, too, the fiber material can be processed continuously after a one-time analysis 9 for impurities without carrying out any additional impurities analysis 9, since a new adjustment of the combing machine is not required. Nevertheless, a sample can be taken from time to time for control purposes, if desired, from the fiber material (fiber sliver 22) leaving the combing machine 4 in order to carry out a new impurities analysis 9.

Although the yarn is spun from separated individual fibers in the open-end spinning machine 6, it has been found on basis of tests which were conducted that the results can be improved even further if the fiber material is evened out before it is subjected to the combing process so that the fiber material is conveyed to the combing machine 4 in a more uniform state. For this reason, an adjustable drawing frame 3, such as shown in U.S. Pat. No. 4,137,487, for example, is provided in the embodiment shown in FIG. 5 between the card 1 and the combing machine 4, instead of a simple drawing frame 5 (which could also be used here in principle).

As FIG. 5 shows, adjustable drawing frame 3 is provided with a driven support roller 30 and with a scanning roller 31 which monitors the thickness of the fiber sliver 200 being conveyed. The scanning roller 31 is supported pivotably on a swivel axis 310 and is subjected to the force of an elastic means 311, e.g., a pressure spring. The pressure roller 31 is connected to a measuring device 32 which measures deviations in the position of said pressure roller 31 and transmits corresponding signals to an analog-digital converter 33 which is connected to a step register 34. An impulse generator is assigned to step register 34, constituting part of a driven roller 370 of the drawing zone 37, according to the design shown. The drawing zone is further provided with driven roller 372 and 374. The rollers 370, 372 and 374 are driven by a common drive 36 to which the roller 370 is connected directly, and the rollers 372 and 374 are connected through a gearing 360, so that rollers 372 and 374 are driven at a prescribed speed ratio with respect to roller 370 in order to maintain the desired drawing effect in the drawing zone 37. The speed ratio depends on the measuring results which are obtained by the scanning roller 31.

The pressure rollers 371, 373 and 375 interact with driven rollers 370, 372 and 374.

The digital/analog converter 35 is connected to the step register 34 in such manner that it reaches impulses coming from the step register 34 with a certain delay. This delay is synchronized to the time required in order to move the fiber sliver 200 from the scanning roller 31 into the drawing zone 37.

As is apparent from the above description, oscillations in the thickness of the fiber sliver 200 and corresponding adjustment of the speed of the driven rollers 372 and 374 is compensated so that a uniform fiber sliver 21 is obtained to be presented to the combing machine 4.

Instead of, or in addition to, such an adjustable drawing frame 3, adjusting means can also be provided for the card 1 in order to ensure delivery of uniform fiber slivers 20.

The more uniform the fiber slivers 21 (which are fed to the combing machine 4), the better is the combing effect of said combing machine 4 and, therefore, also the spinning result with respect to yarn and knitting or weaving properties.

It is also possible to provide an adjustable draw frame 3 downstream of the combing machine instead of a simple, i.e., non-adjustable, drawing frame 5.

What is claimed is:

1. A process for producing yarn, comprising the following steps:

(a) supplying fiber to a card;

(b) carding said fiber to remove impurities therefrom and forming a card sliver from the carded fiber;

(c) analyzing a sample of said card sliver to determine fiber length distribution therein;

(d) combing said card sliver to remove a predetermined portion of said fibers in accordance with the results of the analysis conducted on said sample of said card sliver and producing a combed sliver;

(e) drawing said combed sliver to align the fibers in said combed sliver;

(f) opening said combed sliver to form opened fibers and to remove impurities therefrom;

(g) conveying said opened fibers to an open-end spinning device; and (h) spinning yarn from said opened fibers.

2. A process for producing yarn as set forth in claim 1, including the step of adjusting the combing to remove a predetermined percentage of the fiber in said card sliver.

3. A process as set forth in claim 1, including adjusting the combing step to remove fibers shorter than 5 millimeters from said card sliver.

4. A process for producing yarn as set forth in claim 1, including the further step of analyzing a sample of said combed sliver to determine impurities contained therein and adjusting said combing step so that residual impurities are less than 0.04 percent.

5. A process for producing yarn as set forth in claim 1, including the step of drawing said card sliver to even the fiber material contained therein before subjecting said card sliver to said combing step.

6. A process for producing yarn as set forth in claim 1, including the further step of combing said drawn sliver before opening said combed sliver to align and even the fibers contained in said drawn sliver.

7. A process for producing yarn from staple fiber, comprising the following steps:

(a) supplying staple fiber to a card;

(b) carding said fiber to remove impurities therefrom and forming a card sliver from said carded fiber;

(c) selecting and analyzing a sample of said card sliver to determine distribution by length of the fibers in said analyzed sample;

(d) adjusting an adjustable comber to remove fibers in said card sliver shorter than a predetermined length in accordance with the fiber distribution determined during said analysis of said sliver sample;

(e).combing said card sliver to remove fibers shorter than said predetermined length and forming a combed sliver therefrom;

(f) drawing said combed sliver to align the fibers contained therein;

(g) opening said combed sliver to form opened fiber and to remove impurities therefrom;

(h) conveying said opened fiber to an open-end spinning device; and (i) spinning yarn from said opened fiber in said open-end spinning device.

8. A process for producing yarn as set forth in claim 7, including the step of adjusting the combing to remove a predetermined percentage of the fiber in said card sliver.

9. A process as set forth in claim 8, including adjusting the combing step to remove fibers shorter than 5 millimeters from said card sliver.

10. A process for producing yarn as set forth in claim 7, including the further step of analyzing a sample of said combed sliver to determine impurities contained therein and adjusting said combing step so that residual impurities are less than 0.04 percent.

11. A process for producing yarn as set forth in claim 7, including the step of drawing said card sliver to even the fiber material contained therein before subjecting said card sliver to said combing step.

12. A process for producing yarn as set forth in claim 7, including the further step of combing said drawn sliver before opening said combed sliver to align and even the fibers contained in said drawn sliver.

13. A process for producing yarn from stable fiber, comprising the following steps:

(a) supplying fiber to a card;

(b) carding said fiber to remove impurities therefrom and forming a card sliver from the carded fiber;

(c) combing said card sliver and producing a combed sliver;

(d) analyzing a sample of said combed sliver to determine the impurities contained therein and adjusting said combing step so that residual impurities are less than 0.04 percent;

(e) drawing said combed sliver to align the fibers in said combed sliver;

(f) opening said combed sliver to form opened fibers and to remove impurities therefrom;

(g) conveying said opened fibers to an open-end spinning device; and (h) spinning yarn from said opened fibers.

14. A process for producing yarn as set forth in claim 13, including the step of drawing said card sliver to even the fiber material contained therein before subjecting said card sliver to said combing step.

15. A process for producing yarn as set forth in claim 14, including the further step of combing said drawn sliver before opening said combined sliver to align and even the fibers contained in said drawn sliver.

* * * * *